US006929127B1

(12) United States Patent
Delk, Sr.

(10) Patent No.: US 6,929,127 B1
(45) Date of Patent: Aug. 16, 2005

(54) H AND D EASY DISPLAY

(76) Inventor: Herman L. Delk, Sr., 2229 Buckner St., Petersburg, VA (US) 23805

( * ) Notice: Subject to any disclaimer, the term of this patent is extended or adjusted under 35 U.S.C. 154(b) by 69 days.

(21) Appl. No.: 10/454,486

(22) Filed: Jun. 5, 2003

Related U.S. Application Data

(62) Division of application No. 09/950,754, filed on Sep. 13, 2001, now Pat. No. 6,644,468.

(51) Int. Cl.[7] ..... B65D 85/67

(52) U.S. Cl. ..... 206/449; 206/0.84; 206/484; 383/39; 383/63

(58) Field of Search ..... 206/0.8, 0.81–0.84, 206/37, 38, 223, 449, 454, 484, 811; 383/38–40, 383/63–65

(56) References Cited

U.S. PATENT DOCUMENTS 1,756,974 A * 5/1930 De Marquez ..... 206/0.81
2,449,204 A * 9/1948 Curtis ..... 206/0.83
2,521,792 A * 9/1950 Hollander ..... 206/0.83
2,726,697 A * 12/1955 Rowan ..... 383/38
2,795,260 A * 6/1957 Perry ..... 383/40
4,637,061 A * 1/1987 Riese ..... 383/38
5,030,013 A * 7/1991 Kramer ..... 383/61.1
5,351,813 A * 10/1994 Golovan ..... 220/483
6,321,957 B1 * 11/2001 Rossi ..... 224/221
6,575,627 B2 * 6/2003 Huseman et al. ..... 383/38
2002/0078613 A1 * 6/2002 Roberts et al. ..... 40/800
2003/0029741 A1 * 2/2003 Wells ..... 206/223

* cited by examiner

*Primary Examiner*—Jim Foster
(74) *Attorney, Agent, or Firm*—Patent & Trademark Services, Inc.; Joseph H. McGlynn

(57) ABSTRACT

A kit for holding and displaying coins and paper money. Each sheet for holding coins has two overlying clear vinyl sheets and a third backing sheet. The front sheet has a slit used to insert or remove a coin and is formed in the cover sheet to retain a coin. Behind the clear cover sheet is a display page sheet with indicia thereon that when properly aligned with the cover sheet displays information relating to the coins. The display page for paper money has sheets for holding the paper money and flaps with snap fit seals to protect the paper money.

7 Claims, 4 Drawing Sheets

H AND D EASY DISPLAY

This application is a Division of application Ser. No. 09/950,754, filed on Sep. 13, 2001, now U.S. Pat. No. 6,644,468.

BACKGROUND OF THE INVENTION

The present invention relates generally to display kits, and more specifically to a kit for displaying money such as coins or paper money.

DESCRIPTION OF THE PRIOR ART

Collectors of coins and other items, like paper money, frequently want to display such items. This is especially true when the items are unique due to their age, condition, the small number minted or the distinctive location where minted. To display such items various types of displays have been utilized.

In the present invention a kit is provided for holding both coins and paper money. The kit contains pages that have an aperture or pocket for inserting identifying sheets for the coins, and an air tight fastener for protecting the paper money, which will be detailed in the specification that follows.

SUMMARY OF THE INVENTION

This invention relates to a kit for displaying money such as coins and paper money.

It is the primary object of the present invention to provide for an improved display kit for money such as coins and paper money.

Another object is to provide for such a display kit that has a provision for inserting an identifying sheet for the coins and also a sheet with an air tight fastener for protecting the paper money.

These and other objects and advantages of the present invention will become apparent to readers from a consideration of the ensuing description and the accompanying drawings.

DESCRIPTION OF THE PREFERRED EMBODIMENT

Figure 1:
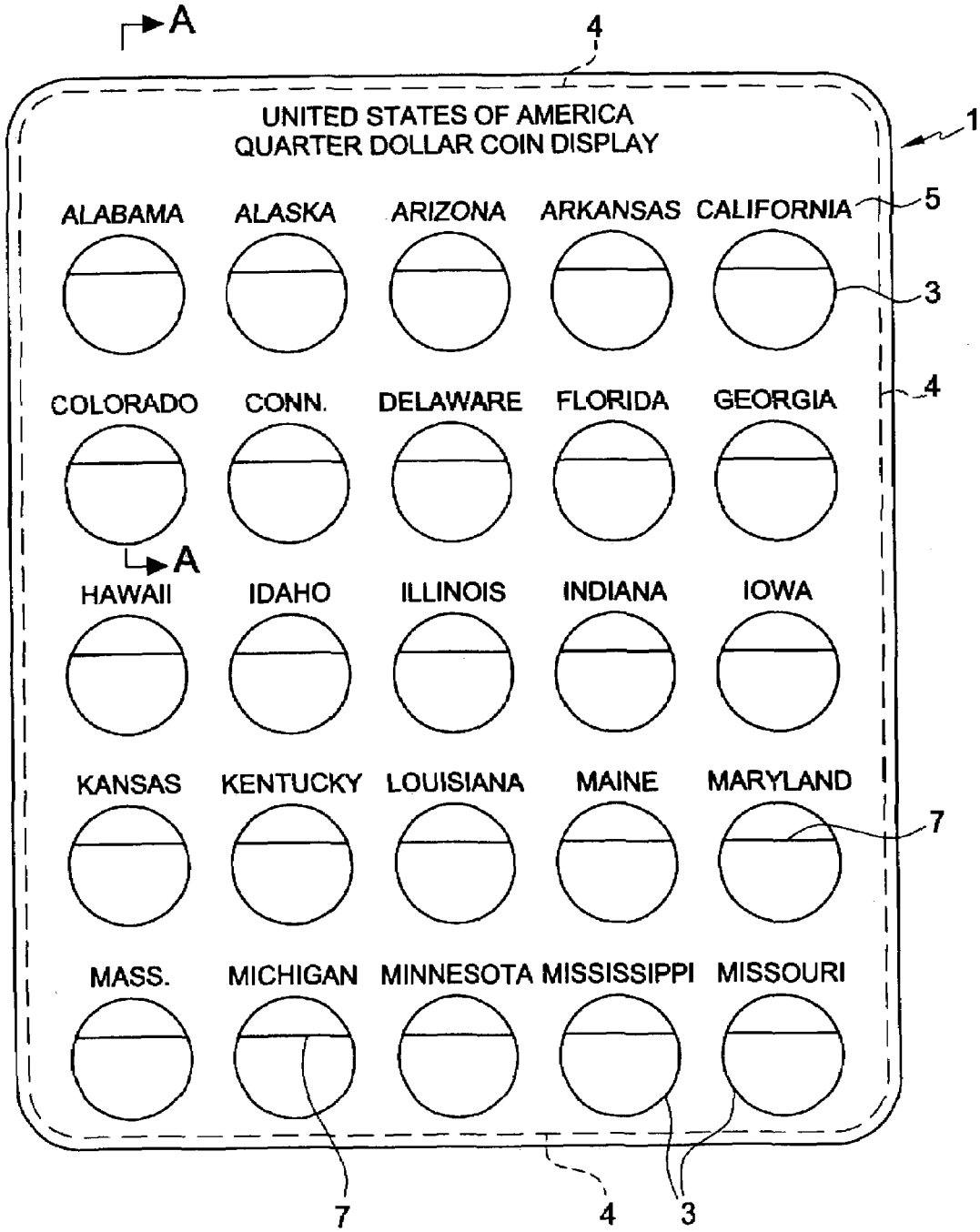
FIG. 1 is a front view of a page used to display coins for different states using the present invention.

FIG. 1 is a front view of a page used to display coins using the present invention. There are two back-to-back, clear display sheets 1 and 4. The outer sheet or cover sheet consist of a transparent vinyl display page 1 which has a series of spaced, circular shaped coin retainer members 3 displayed as rows and columns. The members 3 each have their outside perimeters defined by a circular pattern imprinted on the clear sheet 1. As will be explained with respect to FIG. 3, the material in sheet 1 behind each member 3 has a formed circular pocket slightly larger in diameter that the diameter of each coin which acts to retain the coin. The second sheet 4 has four outer edges, shown in dotted lines, and is a clear vinyl sheet with spaced indicia 5 thereon. Each of the members 3 on sheet 1 has a horizontal slit 7 that extends across the upper front portion of the member to permit a coin to be inserted into, or removed from, a coin retaining pocket formed within the depth of the sheet. One slit 7 extends across each retainer member 3 in the first sheet 1.

The spaced indicia 5, on the second sheet 4, may be any descriptive printed matter, which relates to the coins, such as, but not limited to, the name of a state or states. Sheet 4 is placed between the sheet 1 and a third parallel backing sheet 6 (not shown in FIG. 1, but see FIG. 3) fixed to the first sheet 1. Sheet 4 is slid into position between the sheets 1 and 6 until it is fully inserted in a retaining pocket. When properly fully inserted, with the indicia sheet 4 is in its final position, each indicia 5 on sheet 4 will be adjacent and matched up with each retainer member 3 on sheet 1.

When this is done, the related indicia for each retainer member 3 is displayed through the clear sheet 1 above or adjacent the corresponding retainer member. In the example shown, the indicia on sheet 4 is above each member 3 and indicates each of twenty five of the fifty states of the United States of America. In FIG. 1, the particular coin to be retained is a quarter specifically designed for the named individual state. Each retained coin is inserted through its corresponding front slit 7, in sheet 1, which extends horizontally across the upper portion of the retainer member 3, and into a pocket formed in the backing material making up the depth or thickness of sheet 1. The exact number of retainer members 3 would depend on the number of coins to be displayed, their respective sizes, the size of the page sheet 1 and the spacing between the retainers. In the shown displayed page, there are five columns and five rows for twenty five retainers. Thus, two such pages would be needed to display the fifty different state quarters of the United States.

Figure 2:
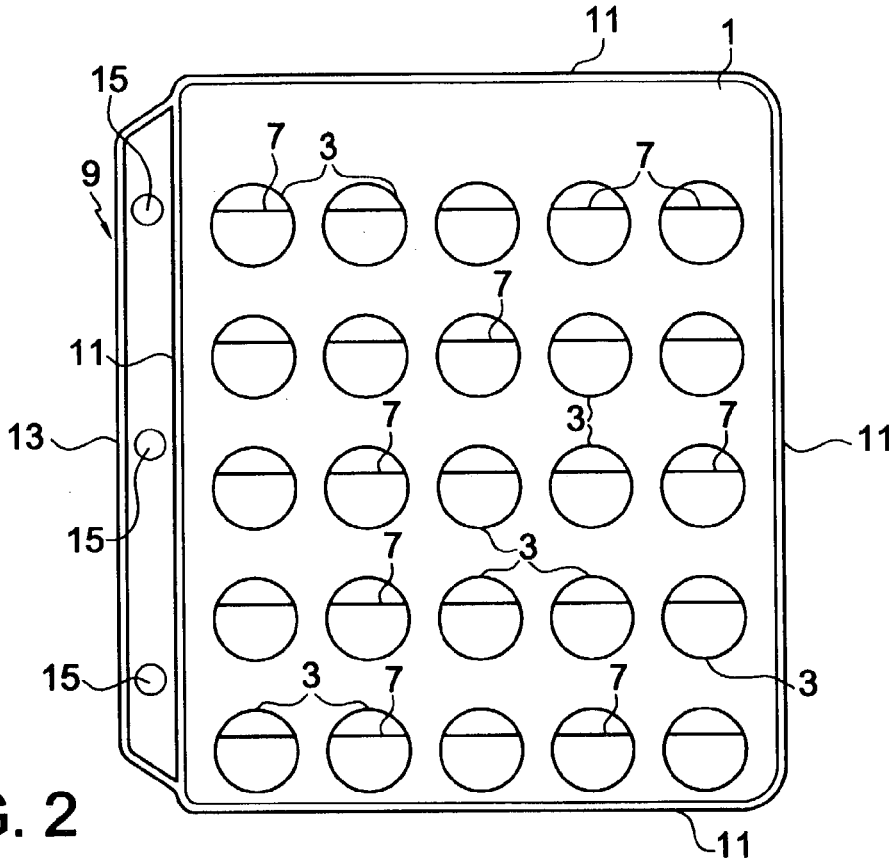
FIG. 2 is a front view of the coin display page of FIG. 1 with an added side edge tab adapted to fit a three ring note book binder.

FIG. 2 is a front view of the coin display page or sheet of FIG. 1 with an added side edge tab 9, extending along one edge of sheet 1 and adapted to fit a three ring note book binder (not shown). The coin slits 7 formed in sheet 1, are each visible in each defined retainer member 3, and are shown positioned in the upper half of the retainer. The sheet 4, that slides behind the clear cover sheet 1, has been omitted in FIG. 2 for simplification purposes. The coin slot, or slit, 7, which is associated with each coin retainer member 3, is shown as a line and is placed in the front surface of clear sheet 1 in front of a rear pocket formed in the same sheet.

Extending around the four edges of the sheet 1, or if in a book, page one, are four raised beaded tear seals 11. Vertical side edge tab 9, joined to the sheet 1 at a side edge, has a similar beaded tear seal 13, and three spaced vertically aligned holes 15. The size and spacing between the holes 15 are chosen to engage a three ring binder, to allow the pages to be added or removed as desired. Thus, when inserted into a binder, the first page is sheet 1 and the second page is back sheet 4, and both are secured in the binder and either page, or both pages, may be changed as desired.

It should be noted that the size and configurations of each coin pocket 17 (see FIG. 3) and their associated members 3, in the FIG. 2 device, may be changed to accommodate coins of different sizes and shapes.

Figure 3:
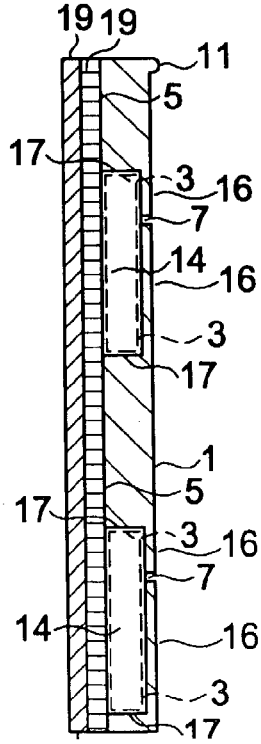
FIG. 3 is an enlarged cross section side view taken along line A—A of FIG. 1 as viewed in the direction of the arrows.

FIG. 3 is an enlarged cross sectional view taken along line A—A of FIG. 1 as viewed in the direction of the arrows. The beaded tear seal 11 is shown extending slightly outwardly from the flat face of the cover sheet or page 1. The circular demarcation, constituting the frontal surface for the retainer member 3, extends around the surface of the sheet 1, and has a diameter slightly smaller than the diameter of the coin to be retained. In this way the edge of the frontal clear surface 16, encompassed within the confines of member 3, acts as an outer retaining surface in front of the rear larger dimensioned coin 14, shown in dotted line format. A circular indentation 17 in the sheet 1 acts as a coin retaining pocket and is slightly larger in diameter that the coin 14 to be retained, and larger than the diameter of the circle defining visible retainer member 3. In this way when the two sheets 1 and 4 are placed back-to-back with the coin insertion slits 7 extending across the upper half sectors of the retainer member 3, all the edges of the coins inserted through the slits 7 will be held in place by the pocket 17 and the front clear surface 16 of sheet 1.

The flexible nature of the vinyl backing material of sheet 1 allows for sufficient deformation to allow a user to remove or insert a coin into the slit 7 and its associated retaining pocket formed by the rear indentation or pocket 17. Behind the indentation 17 is sheet 4 that has the indicia 5 associated with each member 3. Since the material constituting the two sheets 1 and 4 is mostly clear, except for where there is indicia 5 on sheet 4 and the lines delineating the members 3, the coin in pocket 17 is totally visible through the two sheets. The backing sheet 6 is fixed to the cover sheet 1 on its bottom surface, as shown, and may also be fixed to sheet 1 on both sides to form an insertion pocket for the sheet 4 sandwiched between them. Sheet 6 may be about the same surface area as sheet 4, or smaller, and may be a clear material or colored as desired to form an opaque background.

Figure 4:
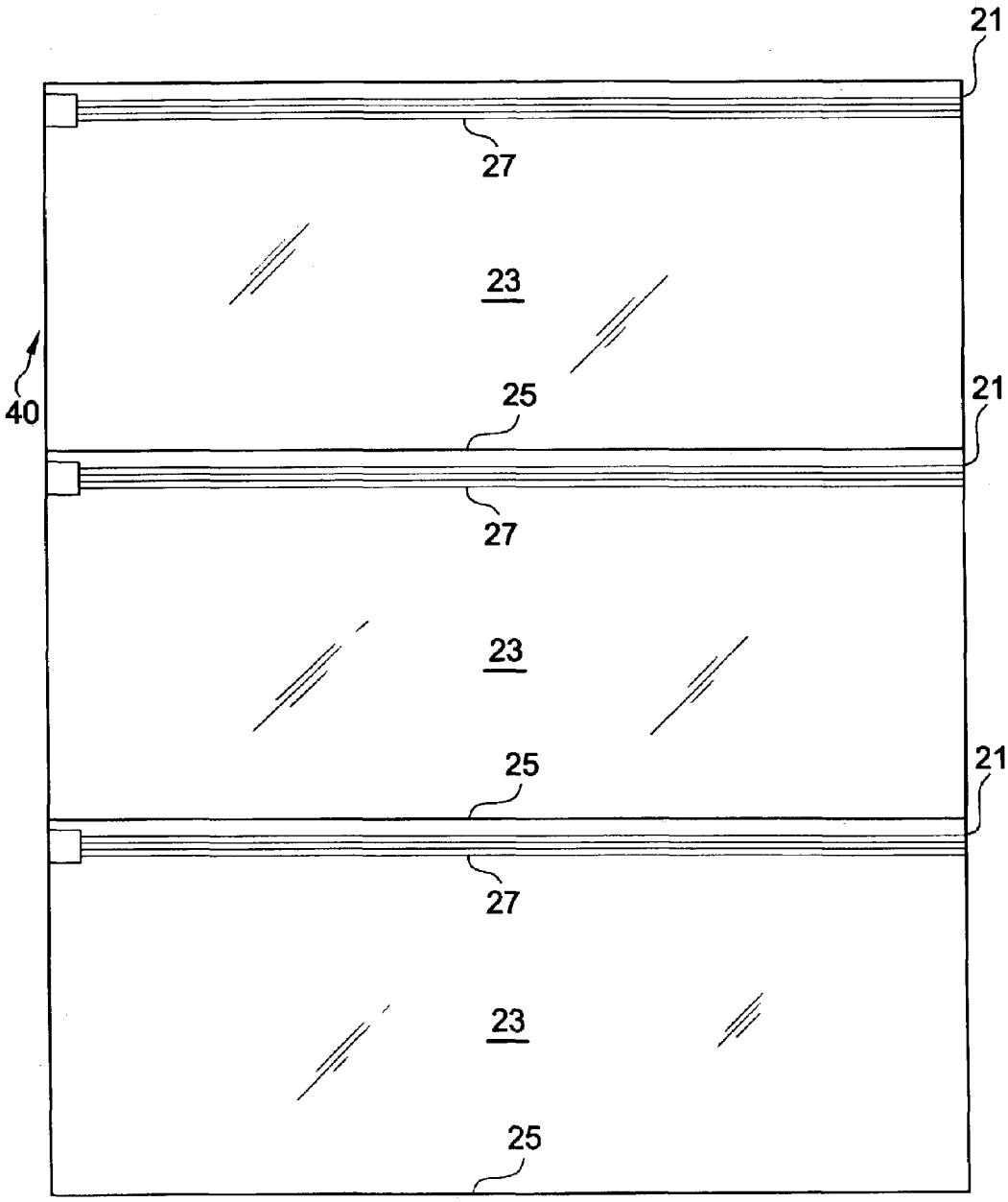
FIG. 4 is a front view of a paper money holder and display page with overlying fasteners.

FIG. 4 is a front view of a paper money holder and display page 40. The term "paper money" as used herein includes, but is not limited to, bills and any generally foldable, non-metallic currency that is not considered a coin. It includes both domestic and foreign currency. An underlying vinyl sheet 21 has three smaller clear sheets 23 bonded at their lower edge 25 to the sheet 21. It should be noted that the number of sheets 23 used are merely for illustration purposes, and fewer or more sheets 23 could be used without departing from the scope of the invention. At the upper edge of each sheet 23 is a seal 27, shown in a sealed position in FIG. 4.

The seals 27 having overlapping engaging portions, part of which are on sheet 21 and part of which are on the facing edge of the overlying sheets 23. A single piece of paper money (not shown) may be placed between each of the sheets 23 and the backing sheet 21. Normally, each sheet 23 is slightly larger than the overall dimensions of the paper money to be displayed, to allow easy insertion of the paper money. Once the paper money is inserted into the pocket, formed between sheet 23 and sheet 21, the two portions of seal 27 are engaged to provide for an air tight seal which will protect the inserted money.

Figure 5:
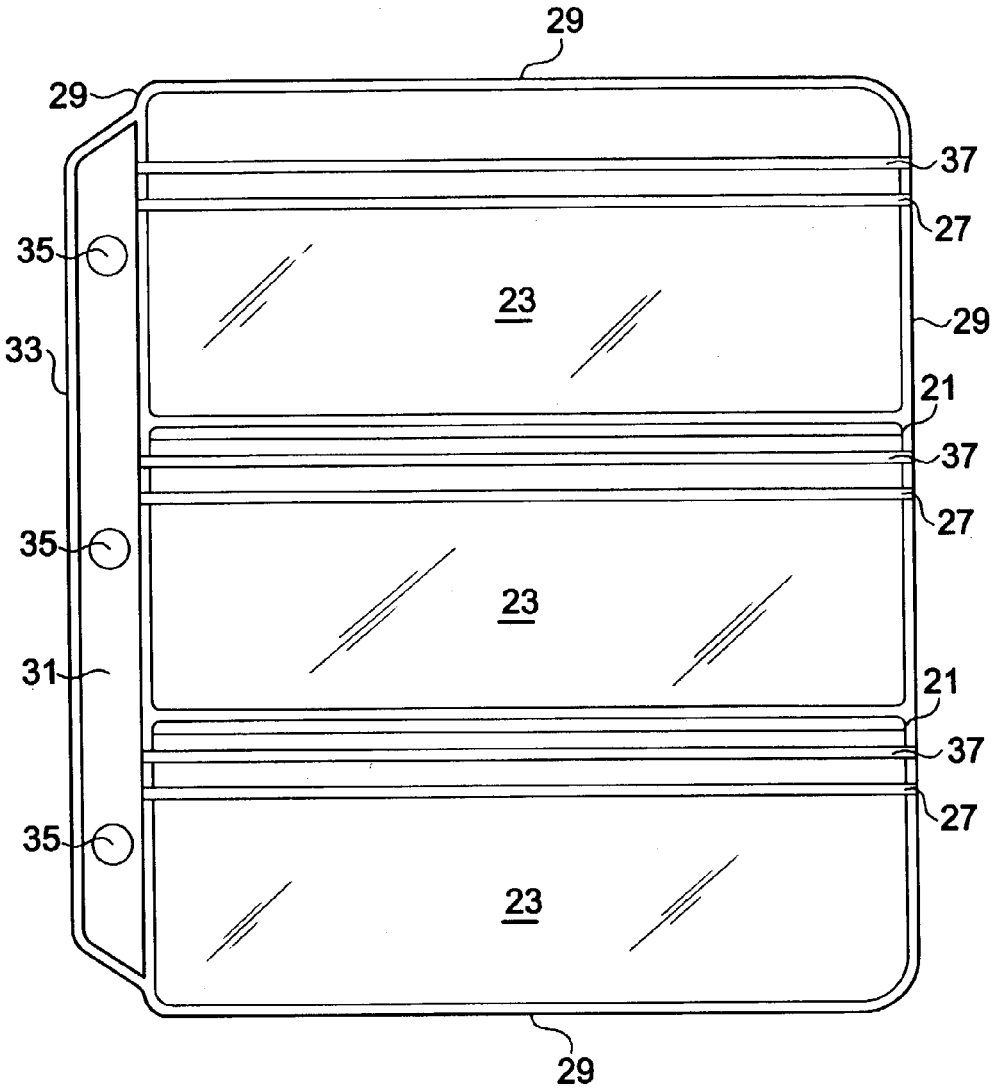
FIG. 5 is a front view of the FIG. 4 embodiment adapted for use with a three ring binder.

FIG. 5 is a front view of the FIG. 4 embodiment and is adapted for use with a three ring binder. In FIG. 5, the fasteners 27 are not engaged. Similar to the coin holder shown in FIG. 2, a small, upstanding, beaded tear seal 29 extends around all four edges of the backing sheet 21. In addition, there is an extending side tab 31 affixed along one side of the sheet 21. Side tab 31 is affixed or molded onto the backing sheet 21. The tab 31 has its own upstanding, beaded tear edge 33 and three spaced holes 35. Three distinct, clear vinyl flaps, or pockets, 23 overlie the underlying larger sheet 21. The upper edges of each sheet 23 mesh with members 37 on sheet 21 (see also FIG. 6) to form a seal 27. The upper edge of sheets 23 are pulled away from the sheet 21 as seen in FIG. 5. The size and spacing between the tab holes 35 is chosen to engage a three ring binder to allow the pages to be added or removed as desired. Thus, when inserted into a book, the sheet 21, with the front pockets 23, are both secured in the binder, and paper money can be inserted between these sheets, and may be changed as desired.

Figure 6:
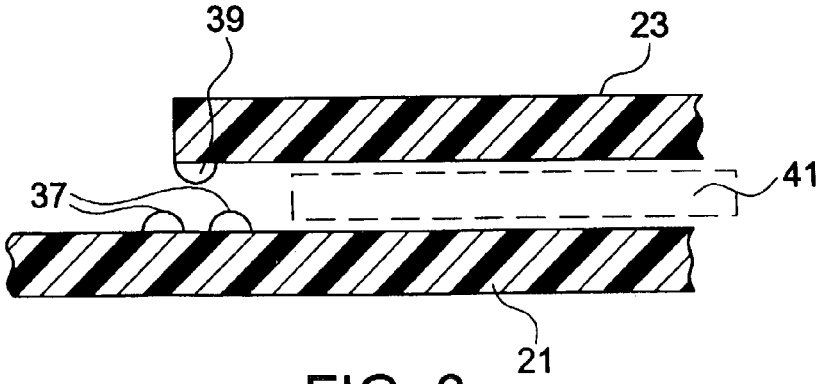
FIG. 6 is an enlarged cross sectional side view of the sealing edges for the paper money fastener shown in FIGS. 4 and 5.

FIG. 6 is an enlarged cross sectional view of the sealing edges for the paper money fastener shown in FIGS. 4 and 5. The mating upper edges 39, on each of the sheets 23, engage members 37 on sheet 21 in an overlapping snap fit manner. By pressing down on sheet 23, the two vinyl sheets 21, 23 are fastened together at their mating edges. The paper money 41, shown partially in dotted lines in FIG. 6, is secured and protected when it is placed between the sheets.

The sizes and configurations of the cover sheets can be changed or adjusted to accommodate different sized paper money or money of different shapes. Thus, they need not be rectangular in shape, as shown, but could be of any desired shape or size, without departing from the scope of the invention.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A display holder for currency comprising:

a first sheet forming an underlying sheet, said first sheet having a length and a width forming an area, and said first sheet having a front and a back surface, a plurality of second sheets, each of said second sheets overlying said front surface of said first sheet, and said second sheets are vertically spaced on said front surface along said length of said first sheet, and each of said second sheets having an edge adjacent said first sheet, and said edge extending across said width of said first sheet, each of said second sheets being permanently attached to said first sheet at said edge, and each of said second sheets having a second edge, each of said second edges being positioned opposite said edge of each of said second sheets, each of said second edges extending across said width of said first sheet, means on each of said second edges and means on said first sheet for forming an air tight seal between said first sheet and each of said second sheets.

2. The display holder as claimed in claim 1, wherein said first sheet has at least a pair of projections thereon, and each of said second sheets has a projection thereon, said projection on each of said second sheets engaging said at least a pair of projections on said first sheet to form said air tight seal.

3. The display holder as claimed in claim 2, wherein said first sheet has a tab extending along a side thereof, said tab having spaced holes to receive notebook ring binders.

4. The display holder as claimed in claim 2, wherein each of said second sheets is smaller in area than said area of said first sheet.

5. The display holder as claimed in claim 2, wherein each of said projections is partial rounded, and said at least a pair of projections on said first sheet are spaced apart a distance, and said projection on each of said second sheets has a width, and said width of said projection on each of said second sheets is smaller than said distance.

6. The display holder as claimed in claim 2, wherein there are three second sheets, and said first sheet has three pair of projections.

7. The display holder as claimed in claim 1, wherein said means on said first sheet for forming an air tight seal comprises projections, and said means on each of said second edges for forming an air tight seal comprises a projection, said projection on each of said second sheets engaging said projections on said first sheet to form said air tight seal.

* * * * *